US011702789B2

(12) United States Patent
Parashar et al.

(10) Patent No.: US 11,702,789 B2
(45) Date of Patent: Jul. 18, 2023

(54) REMOVABLE FILTRATION APPARATUS FOR LAUNDRY TREATING APPLIANCES

(71) Applicant: WHIRLPOOL CORPORATION, Benton Harbor, MI (US)

(72) Inventors: Ketan S. Parashar, Pune (IN); Eric J. Vasko, St. Joseph, MI (US); Mahendra S. Wankhede, Pune (IN)

(73) Assignee: Whirlpool Corporation, Benton Harbor, MI (US)

( * ) Notice: Subject to any disclaimer, the term of this patent is extended or adjusted under 35 U.S.C. 154(b) by 0 days.

(21) Appl. No.: 17/459,317

(22) Filed: Aug. 27, 2021

(65) Prior Publication Data

US 2023/0063526 A1 Mar. 2, 2023

(51) Int. Cl.

| | |
|---|---|
| ***D06F 39/10*** | (2006.01) |
| ***D06F 13/02*** | (2006.01) |
| ***D06F 39/08*** | (2006.01) |
| ***D06F 37/40*** | (2006.01) |
| ***D06F 37/12*** | (2006.01) |

(52) U.S. Cl.

CPC ..... *D06F 39/10* (2013.01); *D06F 13/02* (2013.01); *D06F 37/12* (2013.01); *D06F 37/40* (2013.01); *D06F 39/083* (2013.01)

(58) Field of Classification Search

CPC ..... D06F 39/10; D06F 39/083; D06F 13/02; D06F 37/12; D06F 37/40; D06F 17/10; D06F 39/024; D06F 13/04; D06F 37/145

USPC ..... 68/18 FA

See application file for complete search history.

(56) References Cited

U.S. PATENT DOCUMENTS 2,498,894 A 2/1950 McCormick et al.
2,942,444 A * 6/1960 Abresch ..... D06F 39/10 68/17 A
2,976,711 A * 3/1961 Smith ..... D06F 39/024 68/53

(Continued)

FOREIGN PATENT DOCUMENTS

BR 102012030892-4 A2 9/2014
BR 102012030892 A2 * 9/2014
BR 102012030892-4 A2 11/2018

OTHER PUBLICATIONS

Toledo et al., "Filtering System for Clothes Washing Machine" Sep. 2014, BR 10 2012 030892 A2—Machine Translation (Year: 2014).*

*Primary Examiner* — David G Cormier
*Assistant Examiner* — Thomas Bucci
(74) *Attorney, Agent, or Firm* — Brooks Kushman P.C.

(57) ABSTRACT

A filtration system for a laundry treating machine is provided. A filtration agitator extends upwards from an impeller base and defines a generally hollow cylindrical interior, the filtration agitator having one or more water inlets along its perimeter to permit passage of water from a treating chamber into the interior and one or more water outlets along its perimeter to permit passage of the water out of the interior. A removable cylindrical brush assembly is provided, that, when installed to the filtration agitator, extends along the vertical length of the agitator and defines a sequence of filtration elements through which a water flow passes from the water inlets to the water outlets. The water flow is configured to pass over the sequence of filtration elements in a predefined order to remove particulates from the water flow during a wash cycle.

10 Claims, 3 Drawing Sheets

(56) References Cited

U.S. PATENT DOCUMENTS

| | | | | |
|---|---|---|---|---|
| 3,314,253 | A * | 4/1967 | Smith | D06F 13/00 68/53 |
| 3,330,135 | A | 7/1967 | Douglas | |
| 5,012,658 | A * | 5/1991 | Shikamori | D06F 13/02 68/133 |
| 9,657,421 | B2 | 5/2017 | Manzi et al. | |
| 10,914,031 | B2 | 2/2021 | Piekarski et al. | |
| 10,920,359 | B2 | 2/2021 | Piekarski et al. | |
| 2015/0196859 | A1* | 7/2015 | Levitt | B01D 29/902 210/435 |
| 2017/0128859 | A1* | 5/2017 | Levitt | B01D 29/117 |
| 2017/0362762 | A1* | 12/2017 | Carpenter | D06F 3/04 |
| 2018/0313022 | A1* | 11/2018 | Piekarski | D06F 37/145 |
| 2018/0313023 | A1* | 11/2018 | Piekarski | B01D 33/11 |
| 2018/0313024 | A1* | 11/2018 | Piekarski | D06F 39/088 |

* cited by examiner

REMOVABLE FILTRATION APPARATUS FOR LAUNDRY TREATING APPLIANCES

TECHNICAL FIELD

The present disclosure relates to a removable filtration apparatus for laundry treating appliances.

BACKGROUND

Laundry treating appliances treat laundry items by placing the laundry items in contact with treating fluid such as a detergent/water mixture (sometimes referred to as wash liquor) and providing relative motion between the laundry items and the fluid. A controller may be used to control a motor to rotate the laundry basket or drum according to one of the pre-programmed cycles of operation. The controller may also control a clothes mover provided within the laundry basket or drum to impart mechanical energy to laundry items within the treating chamber according to a selected cycle of operation. The clothes mover can include multiple components, such as a base, which can be provided as an impeller plate, and a barrel, which can be provided as an agitator post, and which can couple to the base.

Lint filters are used in washing machines to capture lint on laundry loads after a wash cycle. The captured lint is retained inside the filter, allowing the consumer to clean the filter after a wash cycle is completed. For customers who do not use clothes drying appliances, it is especially important to trap lint during the wash cycle.

SUMMARY

In one or more illustrative examples, a filtration system for a laundry treating machine is provided. A filtration agitator extends upwards from an impeller base and defines a generally hollow cylindrical interior, the filtration agitator having one or more water inlets along its perimeter to permit passage of water from a treating chamber into the interior and one or more water outlets along its perimeter to permit passage of the water out of the interior. A removable cylindrical brush assembly is provided, that, when installed to the filtration agitator, extends along the vertical length of the agitator and defines a sequence of filtration elements through which a water flow passes from the water inlets to the water outlets. The water flow is configured to pass over the sequence of filtration elements in a predefined order to remove particulates from the water flow during a wash cycle.

In one or more illustrative examples, a removable cylindrical brush assembly for a filtration agitator is provided. The assembly includes a rod, and a sequence of filtration elements extending radially outward along the length of the rod. The filtration elements are configured to remove particulates from a water flow through a hollow agitator such that the water flow passes over the sequence of filtration elements in a predefined order.

In one or more illustrative examples, a method for filtering pet hair for a laundry treating machine is provided. A cylindrical brush assembly is installed to a filtration agitator of the laundry treating machine, the filtration agitator defining a generally hollow cylindrical interior and having one or more water inlets along its perimeter to permit passage of water into the interior and one or more water outlets along its perimeter to permit passage of the water out of the interior, the cylindrical brush assembly extending along a vertical length of the agitator when installed. A water flow is provided from the water inlets to the water outlets through a sequence of filtration elements of the cylindrical brush assembly, thereby removing particulates from the water flow.

DETAILED DESCRIPTION

Embodiments of the present disclosure are described herein. It is to be understood, however, that the disclosed embodiments are merely examples and other embodiments can take various and alternative forms. The figures are not necessarily to scale; some features could be exaggerated or minimized to show details of particular components. Therefore, specific structural and functional details disclosed herein are not to be interpreted as limiting, but merely as a representative basis for teaching one skilled in the art to variously employ the embodiments. As those of ordinary skill in the art will understand, various features illustrated and described with reference to any one of the figures can be combined with features illustrated in one or more other figures to produce embodiments that are not explicitly illustrated or described. The combinations of features illustrated provide representative embodiments for typical applications. Various combinations and modifications of the features consistent with the teachings of this disclosure, however, could be desired for particular applications or implementations.

Pets are an integral part of many families. In such families, pet hair may be found on clothes. It may be desirable to remove such pet hair from the clothes during a wash cycle. It may also be desirable to do so without requiring the user to expend significant effort for removing the pet hair.

As described herein, a filtration agitator is provided. A cylindrical brush or other filter apparatus may be placed at the center of an agitator barrel mounted to an impeller base. The barrel may define slots or other openings for water entry and exit. During a wash cycle, water with pet hair enters the agitator barrel. As the water circulates through the interior of the agitator barrel, pet hair becomes entangled in the bristles of the brush. After the wash cycle (or after multiple cycles), the brush may be removed, cleaned, and replaced. By using the cylindrical brush, consumer time and effort is saved in cleaning the laundry of pet hair. Further aspects of the disclosure are discussed in detail herein.

Figure 1:
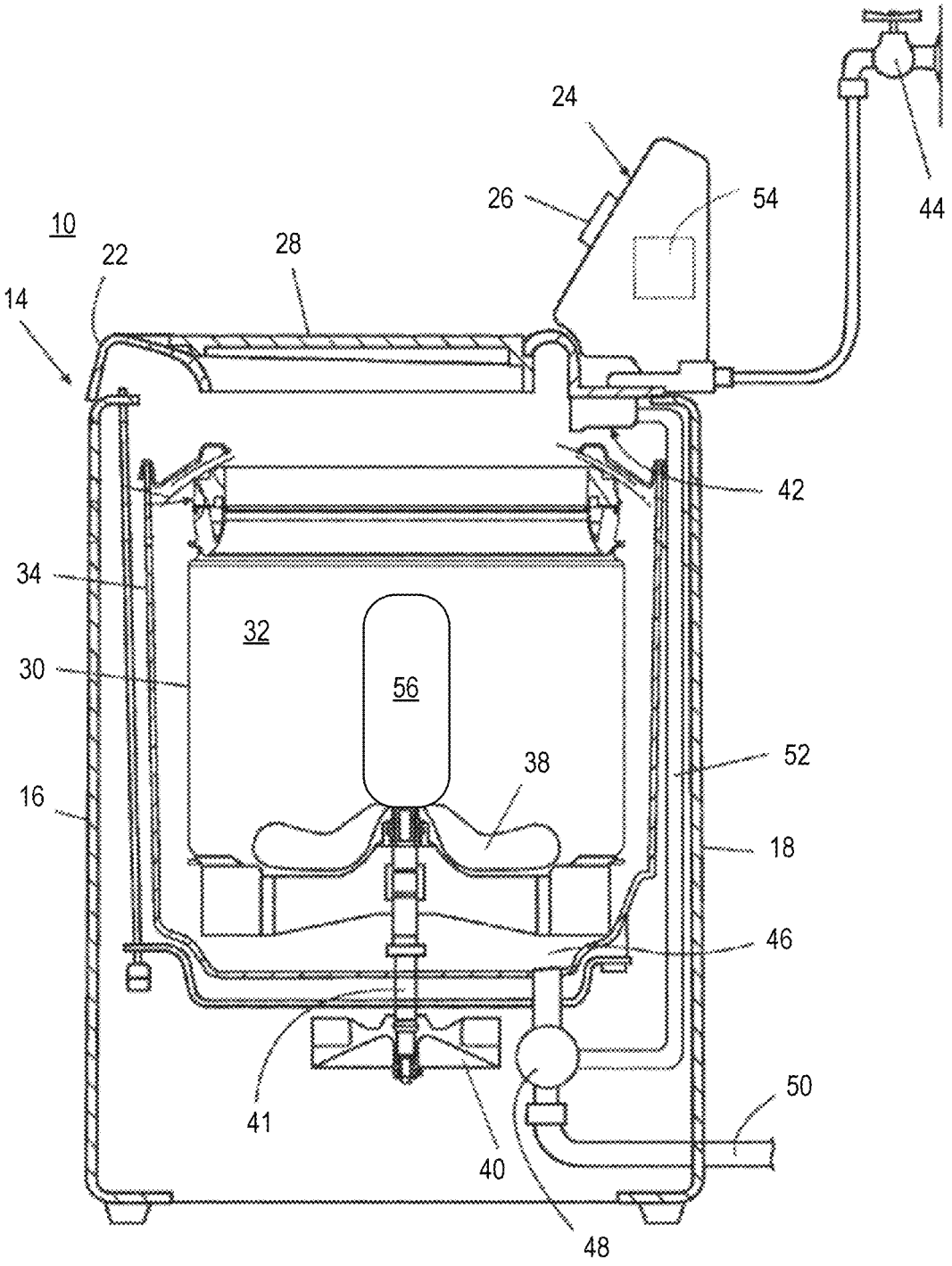
FIG. 1 is a simplified view of a laundry treating appliance having a filtration agitator.

FIG. 1 is a simplified view of a laundry treating appliance 10 having a filtration agitator 56. The laundry treating appliance 10 may be any machine that treats articles such as clothing or fabrics. Examples of the laundry treating appliance 10 may include, but are not limited to, a vertical axis washing machine; a vertical axis dryer (such as a tumble dryer or a stationary dryer), a tumbling or stationary refreshing/revitalizing machine, an extractor, a non-aqueous washing apparatus, and a revitalizing machine. As used herein, the term "vertical-axis" washing machine refers to a washing machine having a rotatable drum that rotates about a generally vertical axis relative to a surface that supports the washing machine. However, the rotational axis need not be perfectly vertical to the surface. For example, the drum may rotate about an axis inclined relative to the vertical axis (e.g., with fifteen degrees of inclination being one example of the inclination).

As illustrated in FIG. 1, the laundry treating appliance 10 includes a cabinet 14 defined by a front wall 16, a rear wall 18, a pair of side walls (not shown) and supporting a top wall 22. A user interface 24 on the cabinet 14 may have multiple controls 26, which may be used to select a cycle of operation. A chassis (not shown) may be provided, with the walls mounted to the chassis.

The top wall 22 may have an openable lid or door 28 and may be selectively moveable between opened and closed positions to close an opening in the top wall 22. In the opened position, the door 28 provides access to the interior of the cabinet 14. A rotatable drum 30 is disposed within the interior of the cabinet 14 and defines a treating chamber 32 for treating laundry. The drum 30 may be positioned within an imperforate tub 34. The drum 30 itself may include a plurality of perforations (not shown), such that liquid may flow between the tub 34 and the drum 30 through the perforations.

A clothes mover assembly 36 can be rotatably mounted within the drum 30 to impart mechanical agitation and energy to a load of laundry items placed in the drum 30 or the treating chamber 32 according to a cycle of operation. The clothes mover assembly 36 may be oscillated or rotated about its vertical axis of rotation during a cycle of operation in order to produce load motion effective to wash the load contained within the treating chamber 32. The clothes mover assembly may include an impeller base 38, and a barrel, illustrated herein as the filtration agitator 56. The filtration agitator 56 as illustrated herein can comprise a vertically oriented agitator post that can be removably coupled with the impeller base 38, the filtration agitator 56 projecting vertically from the impeller base 38 within the treating chamber 32 and toward the open top 13 of the drum 30.

The drum 30 and/or the clothes mover assembly 36 may be driven by an electrical motor 40 operably connected to the drum 30 and/or the impeller base 38 by a drive shaft 41. The clothes mover assembly 36 may be oscillated or rotated about its axis of rotation during a cycle of operation in order to produce high water turbulence effective to wash the load contained within the treating chamber 32. The motor 40 may rotate the drum 30 at various speeds in either rotational direction.

The liquid supply and recirculation system 42 may be provided to spray treating liquid, such as water or a combination of water and one or more wash aids, such as detergent, into the open top of the drum 30 and onto the top of a laundry load placed within the treating chamber 32. The liquid supply and recirculation system 42 may be configured to supply treating liquid directly from a household water supply 44 and/or from the tub 34 and spray it onto the fabric load. The liquid supply and recirculation system 42 may also be configured to recirculate treating liquid from the tub 34, including a sump 46, and spray it onto the top of the load. A pump 48 may be housed below the tub 34. The pump 48 may have an inlet fluidly coupled to the sump 46 and an outlet configured to fluidly couple to either or both a household drain 50 or a recirculation conduit 52. In this configuration, the pump 48 may be used to drain or recirculate wash water in the sump 46, which is initially sprayed into the drum 30, flows through the drum 30, and then into the sump 46.

The laundry treating appliance 10 may further comprise a controller 54 coupled to various working components of the laundry treating appliance 10, such as the motor 40 and the pump 48, to control the operation of the working components. The user interface 24 may be coupled to the controller 54 and may provide for input/output to/from the controller 54. In other words, the user interface 24 may allow a user to enter input related to the operation of the laundry treating appliance 10, such as selection and/or modification of an operation cycle of the laundry treating appliance 10, and receive output related to the operation of the laundry treating appliance 10. Examples, without limitation, of cycles of operation include: wash, heavy duty wash, delicate wash, quick wash, refresh, rinse only, and timed wash. The controller 54 may be a microprocessor-based controller that implements control software and sends/receives one or more electrical signals to/from each of the various components to effect the control software. As an example, proportional control (P), proportional integral control (PI), and proportional derivative control (PD), or a combination thereof, a proportional integral derivative (PID) control, may be used to control the various components.

Figure 2:
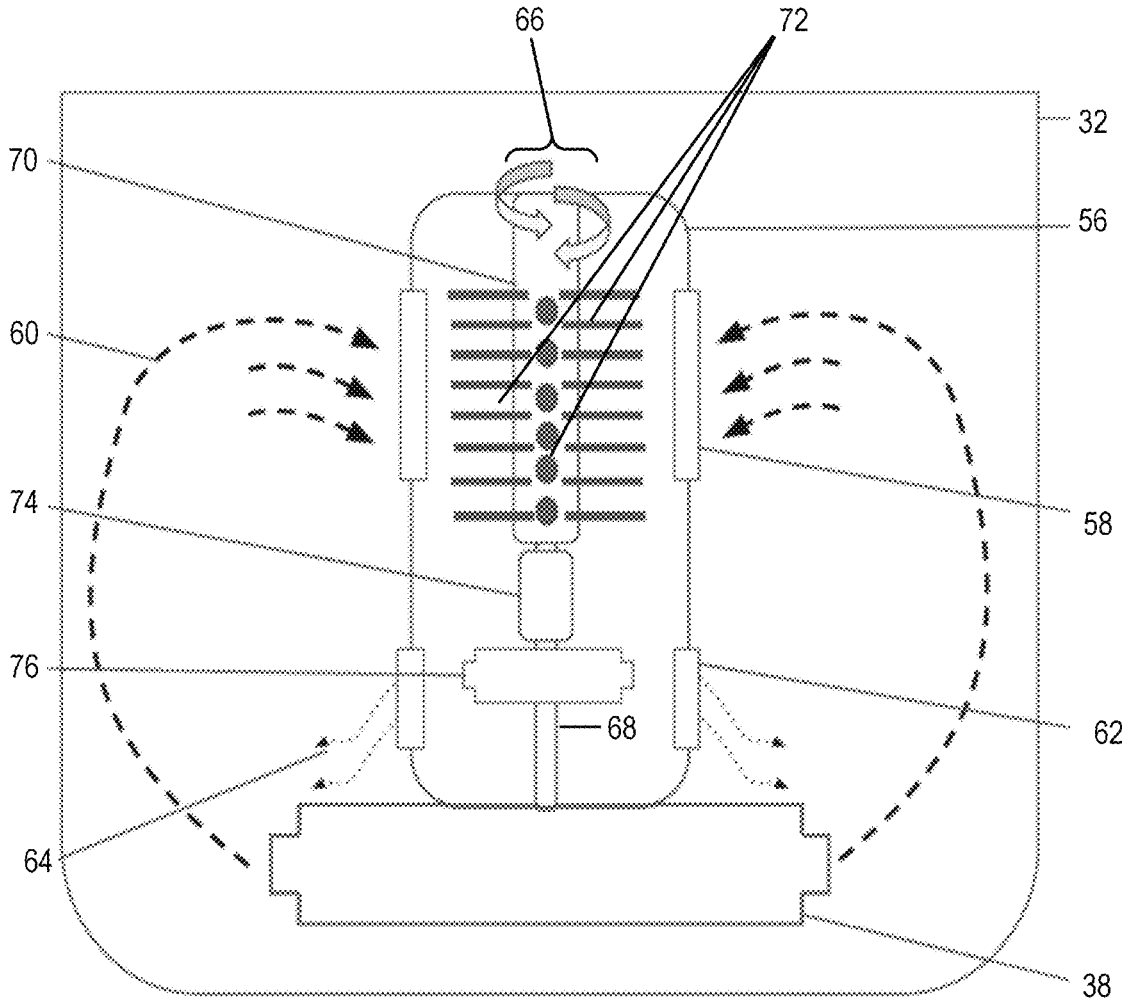
FIG. 2 is a view of further details of the filtration agitator.

FIG. 2 illustrates further details of the filtration agitator 56. As shown, the filtration agitator 56 may define a vertical cylindrical wall that forms a generally hollow interior. While illustrated as being of constant diameter, the filtration agitator 56 may taper along its length to reduce or increase in diameter. The filtration agitator 56 may have a closed bottom, and an open (or selectively closable) top. In some designs, the filtration agitator 56 is fixed to the impeller base 38, while in other designs the filtration agitator 56 may be removable from the impeller base 38.

The filtration agitator 56 may define one or more water inlets 58 along its perimeter to permit the passage of unfiltered water 60 from the treating chamber 32 into the interior of the filtration agitator 56. The one or more water inlets 58 may include various slots, holes, meshes, or other passages through which water from the treating chamber 32 may pass but laundry items may not.

The filtration agitator 56 may also define one or more water outlets 62 along its perimeter to permit the passage of filtered water 64 from the interior of the filtration agitator 56 back into the treating chamber 32. The one or more water outlets 62 may similarly include various slots, holes, meshes, or other passages through which water from the treating chamber 32 may pass but laundry items may not.

The filtration agitator 56 may define a configuration of vanes, blades, or other structural features on its exterior surface (not shown) for imparting mechanical energy to laundry items during a cycle of operation. Generally, the vertical extent of the filtration agitator 56, combined with the vane, blade, or other structural features, imparts the mechanical action to laundry items to improve cleaning performance. The movement of the filtration agitator 56 with respect to the treating chamber 32 may provide agitation of the wash in order to guide the washing liquid towards the one or more water inlets 58, thereby facilitating the passage of the unfiltered water 60 into the interior of the filtration agitator 56.

A removable cylindrical brush assembly 66 may be installed vertically to the center of the filtration agitator 56. For instance, the removable cylindrical brush assembly 66 may be removably mounted to the impeller base 38, such that its vertical axis is centered with respect to the center of the impeller base 38. The removable cylindrical brush assembly 66 may define a vertical rod 68, to which a sequence of filtration elements may be attached to perform the hair and particulate retention. The sequence of filtration elements may be in fluid communication with the unfiltered water 60, such that the water flows over the sequence of filtration elements sequentially in a predefined order.

In some examples, the filtration agitator 56 may have an open top, and the lower end of the rod 68 of the removable cylindrical brush assembly 66 may be placed into an indentation, groove or other connector on the inner surface of the bottom of the filtration agitator 56 to hold the cylindrical brush assembly 66 in place. In some examples, the filtration agitator 56 may have an openable lid or door and may be selectively moveable between opened and closed positions to close an opening in the top wall of the filtration agitator 56. The upper end of the rod 68 may fit into the indentation, groove or other fastener on the underside of the lid of the filtration agitator 56 to further hold the cylindrical brush assembly 66 in place when the lid is closed.

When installed and when the laundry treating appliance 10 performs a cycle of operation, the removable cylindrical brush assembly 66 may filter the unfiltered water 60 to retain pet hair, lint and other objects and particles flowing through the washing liquid, thereby providing the filtered water 64.

The filtration elements of the cylindrical brush assembly 66 may include a coarse particle filter 70. The coarse particle filter 70 may include a bristle brush having a plurality of brush elements 72 extending radially outward from the rod 68. The brush elements 72 of the bristle brush may be formed as rigid bristles, flexible bristles, tufts, or the like. In an example, the removable cylindrical brush assembly 66 may be vertically placed at about the level of the one or more water inlets 58. The coarse particle filter 70 may be responsible for a first aspect of the filtering process, retaining larger pet hairs as they enter the filtration agitator 56 through the water inlets 58.

The filtration elements may further include a fine particle filter 74. The fine particle filter 74 may include a rough surface pad to capture smaller pet hairs located along the rod 68 below the coarse particle filter 70. For example, the rough surface pad may be a foam or plastic pad with a sandpaper-like texture. Thus, the unfiltered water 60 may pass through the coarse particle filter 70 to be freed of hair or other larger particulates that would quickly soil the fine particle filter 74, and then passes over fine particle filter 74 for additional filtration.

The filtration elements may further include a pumping apparatus 76 configured to aid in guiding the filtered water 64 out of the filtration agitator 56 via the water outlets 62 back into the treating chamber 32. The water outlets 62 may be placed, for example, at about the level of the pumping apparatus 76 to facilitate the passage of the filtered water 64.

In an example, the pumping apparatus 76 may define a impeller comprising a series of fins or vanes that extend radially outward from the rod 68 to push water out of the filtration agitator 56. In some examples, the impeller may be powered to actively spin via gearing in the impeller base 38 that selectively connects to the rod 68 when the cylindrical brush assembly 66 is installed to the filtration agitator 56. In other examples, the entire cylindrical brush assembly 66 may be powered to actively spin within the filtration agitator 56. In yet other examples, the coarse particle filter 70, the fine particle filter 74, and/or the pumping apparatus 76 may be mounted to spin freely about its vertical axis during a cycle of operation.

Instead of or in addition to fins, in some examples the pumping apparatus 76 may include another plurality of filter elements extending radially outward from the rod 68, similar to the coarse particle filter 70. In such an example, water flowing the reverse direction through the removable cylindrical brush assembly 66 may also be filtered of larger pet hairs as the water enters the filtration agitator 56 through the water outlets 62.

Figure 3:
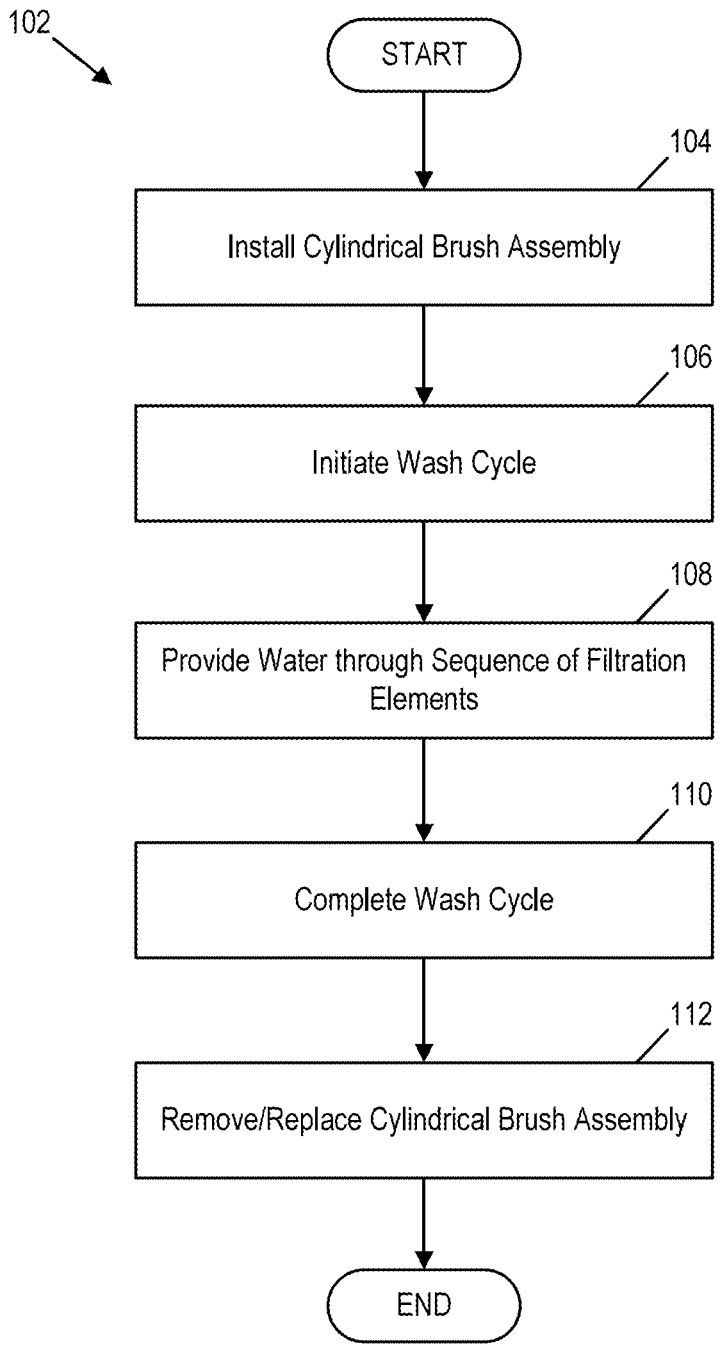
FIG. 3 illustrates an example process for the use of the filtration agitator to wash laundry items.

FIG. 3 illustrates an example process 102 for the use of the filtration agitator 56 to wash laundry items. In an example, the process 102 may be performed using the removable cylindrical brush assembly 66 and the filtration agitator 56 of the laundry treating appliance 10 discussed in detail with respect to FIGS. 1-2.

At operation 104, the removable cylindrical brush assembly 66 is installed to the filtration agitator 56. For instance, the removable cylindrical brush assembly 66 may be installed to an indentation, groove or other fastener of the filtration agitator 56 to hold the cylindrical brush assembly 66 in place. In some examples, the cylindrical brush assembly 66 may be powered to spin during the wash cycle, and gearing in the impeller base 38 may selectively connect to the rod 68 when the cylindrical brush assembly 66 is installed to the filtration agitator 56 to engage the motor 40 to spin or oscillate the cylindrical brush assembly 66 during operation.

At operation 106, a wash cycle of the laundry treating appliance 10 is initiated. For instance, the user interface 24 may receive a selection of an operation cycle of the laundry treating appliance 10. Responsive to the selection, the controller 54 may control the motor 40, pump 48, and/or other working components of the laundry treating appliance 10 to perform the selected cycle.

At operation 108, the laundry treating appliance 10 provides water through the sequence of filtration elements of the cylindrical brush assembly 66 of the filtration agitator 56. During the wash cycle, as water travels through the sequence of filtration elements, lint, pet hair, or other particulate in the water wash may be captured.

At operation 110, the wash cycle of the laundry treating appliance 10 is completed. For example, responsive to completion of the wash cycle as defined by the controller 54, the controller 54 may further operate control the motor 40, pump 48, and/or other working components of the laundry treating appliance 10 to complete the selected cycle.

At operation 112, the removable cylindrical brush assembly 66 is removed from the filtration agitator 56. For instance, the removable cylindrical brush assembly 66 may be lifted out of or otherwise removed from the fastener of the filtration agitator 56. Once removed, the sequence of filtration elements of the cylindrical brush assembly 66 may be cleared of hair or other particulates.

While exemplary embodiments are described above, it is not intended that these embodiments describe all possible forms encompassed by the claims. The words used in the specification are words of description rather than limitation, and it is understood that various changes can be made without departing from the spirit and scope of the disclosure. As previously described, the features of various embodiments can be combined to form further embodiments of the invention that may not be explicitly described or illustrated. While various embodiments could have been described as providing advantages or being preferred over other embodiments or prior art implementations with respect to one or more desired characteristics, those of ordinary skill in the art recognize that one or more features or characteristics can be compromised to achieve desired overall system attributes, which depend on the specific application and implementation. These attributes can include, but are not limited to cost, strength, durability, life cycle cost, marketability, appearance, packaging, size, serviceability, weight, manufacturability, ease of assembly, etc. As such, to the extent any embodiments are described as less desirable than other embodiments or prior art implementations with respect to one or more characteristics, these embodiments are not outside the scope of the disclosure and can be desirable for particular applications.

The invention claimed is:

1. A filtration system for a laundry treating machine, comprising:

a filtration agitator extending upwards from an impeller base and defining a hollow cylindrical interior, the filtration agitator having one or more water inlets along its perimeter to permit passage of water from a treating chamber into the interior and one or more water outlets along its perimeter to permit passage of the water out of the interior; and a removable cylindrical brush assembly, that, when installed to the filtration agitator, extends along the vertical length of the agitator and defines a sequence of filtration elements through which a water flow passes from passes from the one or more water inlets to the one or more water outlets, wherein the sequence of filtration elements includes a coarse particle filter configured to remove particulates from the water flow of a first size entering the agitator through the one or more water inlets, a fine particle filter located after the coarse particle filter in the water flow, the fine particle filter configured to remove particulates from the water flow of a second size, the second size being smaller than the first size, and a second coarse particle filter located after the fine particle filter in the water flow, and/or an impeller located after the fine particle filter in the water flow, the impeller configured to aid in guiding filtered water out of the agitator via the one or more water outlets of the agitator, wherein the water flow is configured to pass over the sequence of filtration elements in a predefined order to remove particulates from the water flow during a wash cycle.

2. The filtration system of claim 1, wherein the coarse particle filter is a bristle brush and the fine particle filter is a rough surface pad.

3. The filtration system of claim 1, wherein the coarse particle filter is located at the same vertical extent as the one or more water inlets, and the impeller is located at the same vertical extent as the one or more water outlets.

4. The filtration system of claim 1, wherein the removable cylindrical brush assembly includes both the second coarse particle filter and the impeller.

5. The filtration system of claim 1, further comprising:

a rod, wherein the sequence of filtration elements extends radially outward along the length of the rod.

6. A removable cylindrical brush assembly for a filtration agitator, comprising:

a rod; and a sequence of filtration elements extending radially outward along the length of the rod and configured to remove particulates from a water flow through a hollow agitator such that the water flow passes over the sequence of filtration elements in a predefined order, wherein the sequence of filtration elements includes a coarse particle filter configured to remove particulates from the water flow of a first size entering the agitator through water inlets of the hollow agitator, a fine particle filter located after the coarse particle filter in the water flow, the fine particle filter configured to remove, particulates from the water flow of a second size, the second size being smaller than the first size, and a second coarse particle filter located after the fine particle filter in the water flow and/or an impeller located after the fine particle filter in the water flow, the impeller configured to aid in guiding filtered water out of the filtration agitator via water outlets of the hollow agitator.

7. The cylindrical brush assembly of claim 6, wherein the coarse particle filter is a bristle brush and the fine particle filter is a rough surface pad.

8. The cylindrical brush assembly of claim 6, wherein the removable cylindrical brush assembly further includes both the second coarse particle filter and the impeller.

9. A method for filtering pet hair for a laundry treating machine, comprising:

installing a cylindrical brush assembly to a filtration agitator of the laundry treating machine, the filtration agitator defining a hollow cylindrical interior and having one or more water inlets along its perimeter to permit passage of water into the interior and one or more water outlets along its perimeter to permit passage of the water out of the interior, the cylindrical brush assembly extending along a vertical length of the agitator when installed; and providing a water flow from the one or more water inlets to the one or more water outlets through a sequence of filtration elements of the cylindrical brush assembly, thereby removing particulates from the water flow, the sequence of filtration elements including a coarse article filter configured to remove particulates from the water flow of a first size entering the agitator through water inlets of the filtration agitator, a fine article filter located after the coarse particle filter in the water flow the fine particle filter configured to remove particulates from the water flow of a second size, the second size being smaller than the first size, and a second coarse particle filter located after the fine particle filter in the water flow and/or an impeller located after the fine particle filter in the water flow, the impeller configured to au n guiding filtered water out of the filtration agitator via water outlets of the filtration agitator.

10. The method of claim 9, further comprising:

removing the cylindrical brush assembly from the filtration agitator; and cleaning the sequence of filtration elements of the particulates.

* * * * *